United States Patent [19]

Cahn

[11] 4,089,744

[45] May 16, 1978

[54] THERMAL ENERGY STORAGE BY MEANS OF REVERSIBLE HEAT PUMPING

[75] Inventor: Robert P. Cahn, Millburn, N.J.

[73] Assignee: Exxon Research & Engineering Co., Linden, N.J.

[21] Appl. No.: 738,604

[22] Filed: Nov. 3, 1976

[51] Int. Cl.[2] ..... G21C 15/12

[52] U.S. Cl. ..... 176/87; 176/39; 60/644; 60/648; 60/652; 60/659; 60/676

[58] Field of Search ..... 176/39, 87; 60/644, 60/648, 652, 659, 676

[56] References Cited

U.S. PATENT DOCUMENTS

| | | | |
|---|---|---|---|
| 3,630,839 | 12/1971 | Podolsky | 60/652 X |
| 3,681,920 | 8/1972 | Margen | 60/652 |
| 3,886,749 | 6/1975 | Pacault | 60/659 X |
| 3,894,394 | 7/1975 | Braytenbah | 60/644 |
| 3,950,949 | 4/1976 | Martin et al. | 60/676 X |
| 3,998,695 | 12/1976 | Cahn et al. | 60/644 X |
| 4,003,786 | 1/1977 | Cahn | 176/39 |

*Primary Examiner*—Peter A. Nelson
*Attorney, Agent, or Firm*—Joseph J. Allocca

[57] ABSTRACT

A method is described for storing the offpeak electrical output of an electricity generating plant in the form of heat by using it to raise the temperature level of a quantity of stored heat retention material and recalling said stored heat during periods of peak power demand in the form of electrical power. During low power demand periods hot water is drawn from a hot water storage means and cooled by flashing it at successively lower pressures. The cold condensate is sent to a cold water storage means while the various flash vapors are fed to appropriate stages of a steam compressor driven by excess power drawn from the electricity generating station. The steam which has been compressed by means of the excess electrical power is directed to heat exchanger means where it is used to heat a low vapor pressure (LVP) thermal energy retention material flowing from cold to hot storage means through the heat exchanger means. By the practice of this invention, heat is transferred, by means of the steam compressor powered by excess electrical power, from hot water (~ 210° F) to the LVP material raising its temperature from a cold storage temperature of about 190°-300° F to a hot storage temperature of about 450°-600° F. The hot LVP material is stored at atmospheric pressure preferably under an inert gas atmosphere. During peak energy demand periods, the process is reversed and the hot LVP material is used to generate steam which runs a turbine thereby producing electrical power from a generator.

9 Claims, 2 Drawing Figures

DIAGRAM I

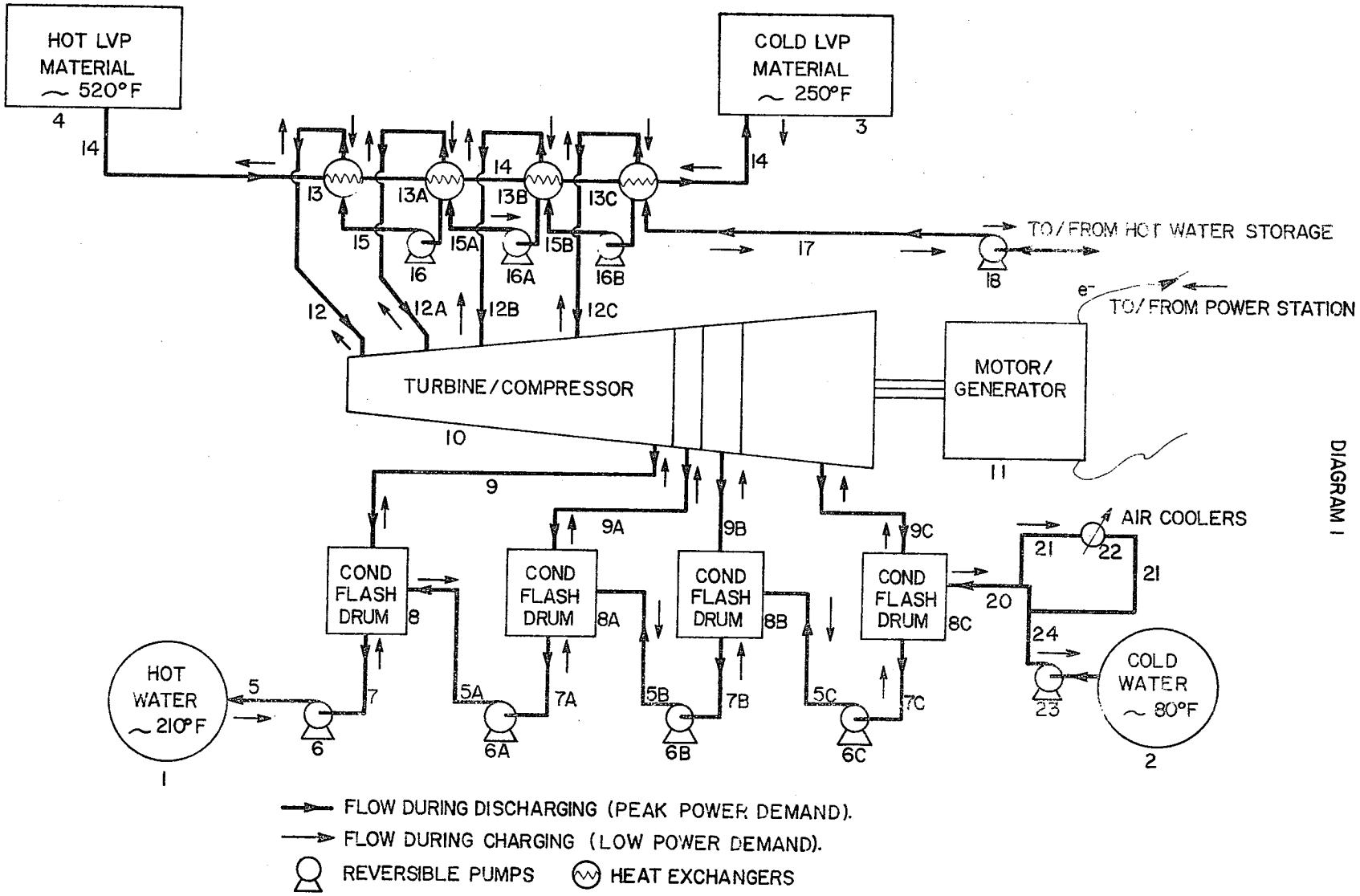
DIAGRAM I
TO/FROM HOT WATER STORAGE
TO/FROM POWER STATION
e⁻
MOTOR/ GENERATOR
11
AIR COOLERS
COLD WATER ~ 80°F
2
COLD LVP MATERIAL ~ 250°F
3
HOT LVP MATERIAL ~ 520°F
4
TURBINE/COMPRESSOR
10
COND FLASH DRUM
8
8A
8B
8C
HOT WATER ~ 210°F
1
FLOW DURING DISCHARGING (PEAK POWER DEMAND).
FLOW DURING CHARGING (LOW POWER DEMAND).
REVERSIBLE PUMPS
HEAT EXCHANGERS DIAGRAM II
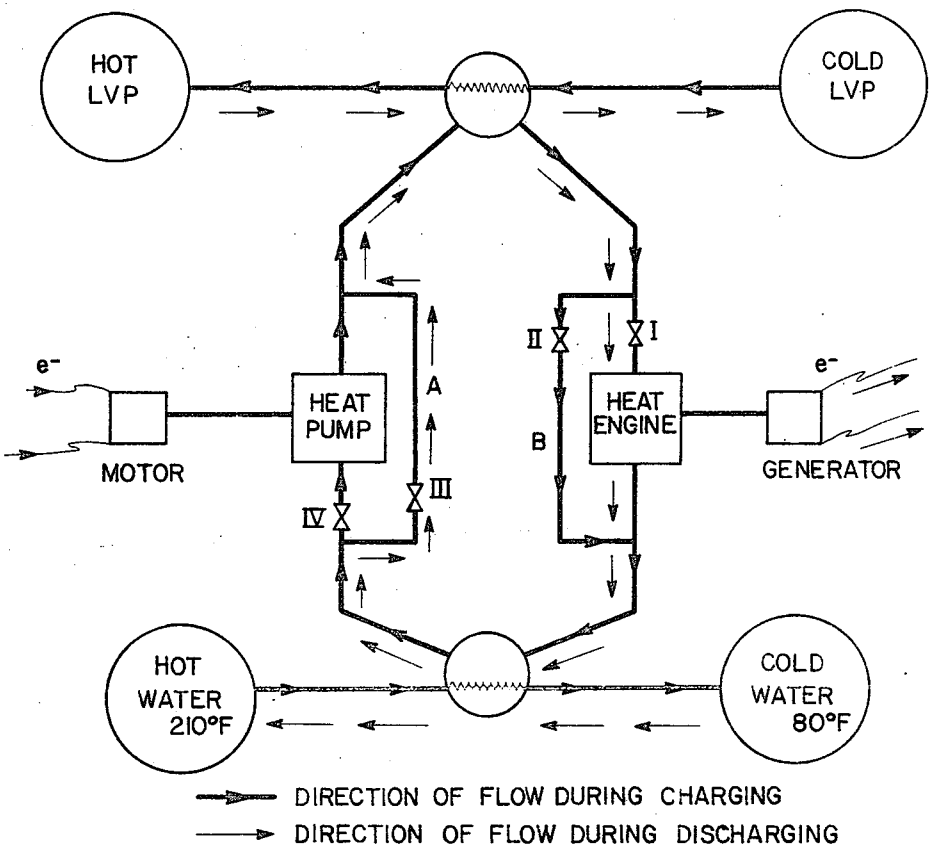

THERMAL ENERGY STORAGE BY MEANS OF REVERSIBLE HEAT PUMPING

DESCRIPTION OF THE INVENTION

A method is described for storing the off peak electrical output of an electricity generating plant by raising the temperature level of a quantity of stored heat retention material and for recalling said stored heat during periods of peak power demand in the form of electrical power. The process utilizes hot low vapor pressure (LVP) thermal energy retention material and appropriate storage means and cold LVP thermal energy retention material and appropriate storage means, a hot water storage means and a cold water storage means, heat exchanger means, steam compressing means, steam turbines, electric motors and electricity generating means. In a preferred embodiment, the steam compressing means and steam turbines may be a single dual purpose apparatus. The same is true for the electric motors and electricity generating means. During periods of low power demand hot water is withdrawn from its storage means and cooled by flashing it at successively lower pressures. The various flash vapors are fed to the appropriate stages of steam compressing means driven by excess power drawn from an electricity generating system. Cold water from the last flash stage and by way of cascade from all previous flash stages, is cooled and stored in cold water storage means. The steam which has been compressed in the steam compression means by means of the excess electrical power flows at different pressures from the steam compression means to heat exchanger means where it is used to heat LVP thermal energy heat retention material flowing from cold storage means to hot storage means through the heat exchanger means. By the practice of the instant invention heat has been transferred, by means of the steam compression means powered by excess electrical power, from the water (at about 100° to 210° F) to the LVP material, raising the temperature of the LVP material from about 150°-300° F (cold) to about 450°-600° F (hot). In effect, the excess electrical power has been used to raise the temperature level of stored heat.

During periods of peak power demand the above-recited process is reversed, the hot LVP material being used to generate steam which in turn powers a turbine thereby running an electrical power generating means to produce electricity, i.e. the conversion of the stored heat at a high temperature level back into electricity and stored heat at a lower temperature level.

By the practice of this invention the excess power generated during off-peak periods can be stored for recall during high power demand periods without the use of gas turbines, etc., which consume our limited and costly natural resources (and increases air and water pollution levels) or the necessity of designing and building overly large power stations merely to handle relatively short term high power demands. The process of the instant invention is independent of the type of electric power station involved, it being useful with nuclear, fossil fuel, solar, geothermal, hydroelectric, tidal, hydrothermal, etc. Since it is the excess electric power which is being stored by conversion into heat, the energy storage, reconversion and utilization means disclosed in the instant invention can be sited close to the load demand area, i.e. close to the center of a metropolitan area since the energy used to charge the heat storage means is excess electric power (traveling over conventional power lines). The storage and retrieval system does not have to be sited near the power plant. Pollution problems are avoided since no fuels are expended in practicing this invention. The power stations which produce the excess electrical power benefit tremendously from the instant invention since they can be run at maximum efficiency. In the case of nuclear power plants, the reactors need not be throttled (a difficult and inefficient use of such a plant). In the case of modern fossil fuel plants, the pollution control devices can be designed and sized for maximum efficiency since the plant can be run at a steady state. Power stations which run in cyclic fashions due to fluctuating power sources (i.e. solar) can be designed for maximum output, with the excess output being stored so as to level the load enabling a cyclic or unavoidably variable output station to satisfy load demand which do not match the output characteristics of the station.

In addition, it can be retrofitted into any power system subsequent to the design and construction of any of the power plants in the system.

PRIOR ART

French Pat. No. 2,098,833 issued Mar. 10, 1972 to Babcock-Atlantique discloses a heat accumulation system for balancing off-peak and peak demands in a thermal power producing unit. The heat accumulation system stores the high level heat made available at the power house by means of a compressor which acts as a heat pump on high pressure primary steam during off-peak periods. This enables the temperature of a heat transfer fluid to be raised to a temperature sufficient to superheat steam to a high pressure turbine during peak demand periods so that a power unit with a rated capacity below peak load can carry the load by utilizing this heat stored during off-peak periods. The process utilizes as a heat source, the primary high pressure steam drawn from the power cycle, an expansion machine for the working fluid, means for circulating one or more fluids, a heat accumulator and an apparatus for compressing the fluid containing the heat to be stored before transferring the heat to the accumulator. The heat accumulator used in the system is a single vessel wherein the heat is stored by its transfer from a heat transfer fluid to corrugated plates. The heat is stored in the ceramic packing of the accumulator which of necessity results in a continuous degrading of the level of the heat on the accumulator. The important difference is that patentee is sited at the powerhouse and works with the primary power cycle. The instant invention is independent of location, cycle, retrofit size of unit and flexibility and nuclear regulations, safety, oil contamination and oil fouling of the main plant heat exchangers.

By way of comparison, the instant invention utilizes stored hot water as a primary heat source for the charging cycle and a stored mobile heat retention material, that is, a heat retention material moving from a hot storage location to a cold storage location. Such movement of the LVP thermal energy heat retention material exhibits the distinct advantage over nonmoving heat retention systems (accumulators) in that by moving the LVP material the water being heated and boiled is continuously being contacted with full high temperature LVP material for as long as there is material stored in the high temperature vessel. This means that for the entire period of peak power demand, or for as long as there is material stored in the hot storage vessel the water will contact uniformly hot material and will therefore be converted to steam under constant conditions. By comparison, in a fixed bed thermal accumulator heat is stored by passage of a hot thermal energy carrier fluid through the bed. On flowing from one end to the other of said accumulator, the fluid will give up heat by thermal conduction to the solid tiles or ceramic particles making up the bed, resulting in a temperature front advancing along the bed in the direction of flow. Behind this front, the temperature of the solid will be close to the temperature of the entering hot fluid. Ahead of this front the temperature of the solid and fluid will be essentially that of the packing when the operation started. The width of the front (length of bed over which the temperature changes from that of the hot fluid to that of the cold packing) is a function of many parameters including heat capacities and heat transfer properties, fluid flow rate, bed and particle diameter, etc. Also, the regularity or evenness of the front is very much a function of flow distribution, channeling, flow rates, etc.

The same holds true when the bed is hot and the entering fluid is cold, except all temperature indications are reversed.

The net effect of using a fixed bed accumulation at initial temperature $T_a$ on a fluid flowing through it with initial temperature $T_i$ is that the fluid will leave the accumulator at a temperature close to $T_a$ for a period of time set by the time required for the above temperature front to advance through the length of the accumulation. This time is strictly a function of the heat capacity of the flowing fluid vs the heat capacity of the total accumulator packing.

When the front of the temperature front "breakthrough" reaches the end of the accumulator, the temperature of the fluid leaving the accumulator will slowly change from close to $T_a$ to close to $T_i$. The ratio of the length of time over which the effluent fluid is at a more or less constant temperature $T_a$ to the length of the varying temperature period is a measure of the efficiency of the solid accumulator method of storing heat. In real world situations due to slow heat transfer, poor liquid distributions and channeling and superimposed thermal convection currents, the ratio of constant/-varying effluent temperature periods is not sufficiently high to make this a preferred method of storing heat. Other disadvantages of storing heat in a solid accumulator system are expansion and contraction of the solid resulting in stresses and breakage, formation of fines which foul exchanger and the high cost of the accumulator and filtering devices. The specific heat of solids is usually much lower than that of liquids, resulting in a large weight and physical volume (allowing for voids) penalty and corresponding interstitially held up liquid in these large packed containers.

Another difference is that the invention of Babcock-Atlantique has its compression step work upon high pressure primary steam drawn from the boiler. This primary steam is sent to a compressor powered by direct coupling to the turbine. Of necessity this system must be located within the very confines of the power station. By comparison, the process of the instant invention utilizes stored hot water as to charging cycle heat source, flashes this hot water to steam which nonprimary steam is then compressed in heat pump means, said heat pump being run by excess electrical power drawn from the power grid.

In the practice of this invention, the heat storage medium is described as a low vapor pressure organic heat retention material. Such an LVP material is a hydrocarbon oil preferably one derived from petroleum by distillation and refined, if necessary, by catalytic treatment for the hydrogenation of unsaturates and/or for the removal of sulfur and/or nitrogen in the presence of hydrogen under pressure utilizing any of the standard catalysts known in the art such as cobalt-molybdenum, nickel-molybdenum, etc. The hydrocarbon distillate can also be treated by means of solvent extraction to remove unstable, easily oxidized compounds which could lead to sludge and deposit formations on hot heat exchanger means surfaces. The LVP material can also be dewaxed by use of appropriate low-temperature crystallization/separation techniques known in the art to improve the low temperature handleability, (i.e. viscosity and fluidity) of the material. Before being treated as described above, the hydrocarbon distillate can be thermally and/or catalytically cracked to remove any thermally unstable material present but such cracking should be followed by hydrogenation to remove any unsaturates resulting from the cracking.

The hydrocarbon distillate used should be the fraction within the boiling range of 500° to 1300° F, preferably 600° to 1100° F and most preferably 650° to 1000° F. The vapor pressure of the material used for such thermal energy storage should not exceed 1 atmosphere at the maximum utilized storage temperature and should preferably be below 0.25 atm and most preferably below 0.1 atm. Such low vapor pressures are preferred since they facilitate the use of unpressurized storage means, transport means and heat exchanger means and such unpressurized systems are naturally more economical, desirable and more easily maintained. Such materials of low vapor pressure are kept in isolation from the environmental atmosphere so as to avoid material degradation, by means of an inert gas atmosphere blanketing the stored material or may be accomplished by use of an insulated floating roof or diaphragm type apparatus over the stored material, or by a combination of these two systems. It should be noted that the higher the vapor pressure, or even the closer the vapor pressure gets to 1 atm problems arise in systems isolation and materials handling. Inert gas transfer and balance between hot and cold storage means is a potential problem when the organic material has a vapor pressure approaching or exceeding 1 atm at the hot storage temperature.

Typical materials which qualify as LVP organic heat retention materials are exemplified but cannot be viewed as exhaustively disclosed by the following:

Vacuum gas oil obtained from crude 650° F VT atmosphere pipestill bottoms by running in a vacuum pipestill, getting a 650°/1050° F VT cut. followed by hydrodesulfurization over a catalyst in the presence of $H_2$ under pressure;

The vacuum gas oil described above further treated by solvent extraction to remove unsaturates, sulfur and nitrogen compounds and aromatics;

Catalytic cracking cycle stock with a boiling range of from about 600° to 950° F drawn from a recycle catalytic cracker followed by hydrotreating. The feed to the catalytic cracker, which is usually a material with a boiling range of from 500° to 900° F may but does not necessarily have to have been hydrotreated for sulfur removal prior to cracking;

Thermally cracked gas oil, i.e. steam cracked gas oil in the 600° to 1000° F boiling range after appropriate catalytic hydrotreating to saturate olefins and diolefins and to decrease sulfur and nitrogen content;

Double extracted and dewaxed 600° to 1000° F VT vacuum pipestill fraction, suitably hydrotreated (hydrofined);

600° to 900° F VT fraction obtained from hydrocracking, a process in which heavy gas oils are catalytically broken down and hydrogenated over a catalyst in one or more steps;

600° to 900° F VT coker gas oil suitably stabilized by catalytic hydrogenation.

The sulfur levels in the feeds considered may range, prior to hydrogen treatment, from 0.3 to 5.0% and should be of the order of 0.05 to 1.0% following treatment.

Oxidation stability additives and sludge dispersants and depressants may be added to the material to improve its performance in the hot LVP thermal energy retention material (i.e. oil) storage locations. Typical antioxidants are hindered phenols, such as t-butyl phenol and typical dispersants may be sulfonates or ashless dispersant based adducts. The content of the antioxidants and dispersants in the LVP material will preferably be below 1% each.

BRIEF DESCRIPTION OF THE DIAGRAMS

Diagram I is a schematic representation of the basic heat storage-retrieval system utilizing reversible heat pumping.

Diagram II represents a modification of the basic concept using independent intermediate loops in conjunction with an intermediate heat transfer fluid.

Diagram I is a schematic representation of the basic concept of the instant invention. Arrows appearing directly on the conduit lines indicate direction of material flow during discharge operation while arrows appearing adjacent to conduit lines indicate direction of material flow during charging operations.

At the start of the charging operation which normally occurs during low power damand periods, i.e. during periods when excess electrical power is available the hot water vessel 1 is full, cold water vessel 2 is empty, cold low vapor pressure material (oil for the sake of brevity) storage vessel 3 is full and hot oil storage vessel 4 is empty.

The stored hot water from (1) is directed successively through conduits 5–5C to reversible pumps 6→6C (these pumps are optional) and from 6–6C to conduits 7–7C for introduction into flash drums/condensers (8–8C) wherein the hot water is successively flashed at successively lower pressures to yield steam at decreasing pressure and residual water at decreasing temperature. This water is combined with the hot water moving in cascade fashion from condensers 13 to 13C. At the last flash drum/condenser the water which remains and which cannot be flashed to steam is directed through conduit 20 to conduit 21 for passing through coolers, which may be air coolers 22 and then through conduits 24 through reversible pump 23 to storage in cold water storage means (2). The steam from the different flash drums 7–7C is fed by conduits 9–9C to the compressor/-turbine 10 at varying stages. Compressor/turbine 10 is driven by excess power drawn from the power grid which excess power is used to run the motor/generator 11 which in turn drives the compressor/turbine. Steam compressed at different pressures within the compressor/turbine 10 by means of excess grid power is directed through conduits 12–12C to heat exchanger means 13–13C wherein the high temperature steam from the compressor/turbine 10 is contacted by direct or indirect heat exchanger with cold oil drawn from storage means 3 and directed through conduit 14 to heat exchangers 13–13C. At the heat exchangers the cold oil is heated by contacting with the high temperature compressed steam. This heating is conducted so that the oil is being heated with steam of continuously higher condensing temperature. The condensate from each successive heat exchanger is directed cascade fashion to successively lower temperature exchanges through conduits 15–15B and optional reversible pumps 16–16B. In this manner, maximum heating efficiency is achieved. The hot oil in conduit 14 after passage through the last heat exchanger is directed to storage means 4. The condensate from the last heat exchanger is directed through conduit 17 and reversible pump 18 to hot water storage means 1 or to flash drum 8.

During periods of peak power demand all flows are reversed, the hot oil being used to heat water in the heat exchanger to produce steam of varying pressure which steam is fed to a turbine to generate electrical power. The spent steam is led to condensers where it is converted to hot water, at the same time heating cold water being pumped from cold water tank to hot water tank 1 through condensers 8C to 8. Hot water is stored for use during low power demand periods.

This system has the major advantage of being completely independent of the location of the power station since the excess power which is stored is electrical power coming off the grid which power is converted indirectly to heat by running a compressor. By this means the storage facility can be located a considerable distance from the power station; the storage facility can be sited at the very heart of the peak demand load center. Furthermore, the facility is completely independent of the source of the power. The power can be generated by hydroelectric, nuclear, solar, fossil fuel, tidal, geothermal, fusion, etc., stations. As long as the power is in the form of electricity it can be stored by utilization of this process.

The heat pump energy storage-energy retrieval system can also be located close to the electricity source. When this is done, the LVP thermal energy heat retention material is heated by means of turbine extraction steam and primary high pressure steam as described in Ser. No. 533,263, now U.S. Pat. No. 3,998,695 and Ser. No. 613,754, now U.S. Pat. No. 4,003,786. The stored hot LVP thermal energy retention material can be used either to preheat boiler feed water (as taught in U.S. Pat. No. 3,998,695 and 4,003,786) or it can be used to generate steam to run a turbine (as taught as the second step of the instant process), or both processes can be practiced simultaneously. It should be noted that when the heat pump facility is located close to an electricity source, the equipment of the heat pump facility is available as an auxiliary electricity generating station. In the event the neighboring primary electricity source is forced to shut down, the heat pump facility can then function as described in the instant specification, drawing electric power from the main power grid converting it to heat, storing said heat and reconverting the stored heat into electricity during periods of peak power demand.

In an alternative embodiment an independent intermediate loop can be employed between the stored, moving hot water-cold water circuit and the stored moving hot LVP material-cold LVP material circuit. Referring to Diag. II, during charging, the stored hot water is contacted in heat exchanger means with an independent intermediate heat transfer fluid such as freon, ammonia, propane, propylene, butane, pentane, water, i.e. any thermal fluid which has characteristics compatible with compression means-expansion means operations. This thermal fluid in the independent circuit is vaporized by its contact with the hot water and is compressed in the compression means which is run by a motor powered by excess electricity drawn from the power grid. This compressed vapor, now at a higher temperature, is contacted in heat exchanger means with an LVP organic thermal energy retention material moving through said exchanger means on its passage from cold to hot storage means. During periods of peak power demand the hot LVP material is transported to cold storage means through heat exchanger means wherein the hot LVP material is contacted, directly or indirectly, in heat exchanger means with the intermediate heat transfer fluid previously described moving through the independent intermediate loop thereby transferring heat to said fluid and evaporating it at elevated pressure. Said fluid thereupon is conducted to a heat engine whereby its thermal energy is converted to mechanical energy which is used to power a generator resulting in the production of electricity. The intermediate heat transfer fluid transfers its residual heat (usually in the form of latent heat) to water in heat exchanger means whereby said water is heated and stored for use during nonpeak periods as disclosed above.

During periods of low power demand, valves III and I are closed, permitting the passage of the intermediate heat transfer fluid in the independent loop through the heat pump thereby raising its temperature prior to contacting with the LVP thermal energy retention material resulting in heat transfer. During periods of maximum power demand, valves IV and II are closed (III and I open) directing the flow of the intermediate heat transfer fluid heated by the moving hot LVP material through the heat engine thereby generating current. The partially spent intermediate heat transfer fluid coming from the heat engine is used to heat cold water which is then stored as hot water for use during periods of low power demand as a heat source. Conduits A and B may be combined into a single conduit by the application of ordinary engineering modifications and appropriate valving changes. The heat engine and the heat pump may likewise be combined into a single piece of machinery by the exercise of ordinary engineering techniques.

In any of the embodiments or variations taught or suggested by the instant disclosure various modifications in the apparatus utilized may be made without deviating from the concept of the inventive process. For example, the separate hot and cold water storage means can be replaced by a single vessel wherein the hot and cold water are kept separate by either the use of an insulating diaphragm or merely by the inherent density differences of the stored water. It must be noted however, that the same type of modification cannot be utilized for the storage of hot and cold LVP energy storage material since the difference between the temperatures would subject the storage vessel to unacceptable physical strain and subsequent deterioration.

The heat exchanger means encompasses any viable method of heat transfer. The exchanger can be the classic shell-tube type heat exchanger or greatly simplified so that heat is transferred from steam to LVP or LVP to water by the direct contact of the two materials. Those skilled in the art will be able to fashion many such refinements of the instant process now that the basic inventive process has been disclosed. Such refinements will not detract nor will they add to the process of the instant invention, such modification falling totally within the scope of the invention.

As previously stated, it is also possible to combine the function of two apparatus in a single mechanism. For example, the separate heat pump means and turbine can be integrated into a single machine capable of both functions (clearly however, at different times) coupled into either separate electric motors and electric generators or a combined motor/dynamo apparatus.

It must be understood that the representations contained in Diagrams I and II are merely two of the typical ways in which the concept of the instant disclosure can be utilized, any number of modifications being possible and within the scope of ordinary engineering procedures which will not detract or stray from the scope of the instant disclosure.

What is claimed is:

1. A process for storing the excess electrical output of an electricity generating system by raising the temperature level of a quantity of stored low vapor pressure (LVP) organic heat retention material, and recalling said heat from said LVP organic heat retention material during periods of peak power demand for reconversion into electrical power comprising the steps of:

(a) during periods of low power demand drawing hot water from a hot water storage location means;

(b) flashing said hot water at successively lower pressures to generate steam and cooling resultant residual water condensate to form cold water which is stored in cold water storage location means;

(c) conducting said flashed steam to various stages of a compression means;

(d) driving said compression means by means of a motor means powered by means of excess electrical power produced by an electricity generating system;

(e) compressing the flashed steam in the compression means being driven by the excess electrical power;

(f) conducting the compressed steam at different pressures from the different stages of the compression means to heat exchanger means;

(g) contacting the compressed steam with a low vapor pressure organic thermal energy retention material moving from a cold storage location means to a hot storage location means through the heat exchanger means of (f);

(h) storing the hot LVP thermal energy retention material in the hot LVP material storage location means;

(i) during periods of peak power demand converting water into steam by contacting said water with hot LVP material moving from hot storage location means to cold storage location means, said contacting occurring in heat exchanger means;

(j) conducting the steam generated in step (i) from the heat exchanger means to an expansion engine means thereby converting heat energy into mechanical motion;

(k) running a generator by means of the mechanical motion produced in step (j) thereby effecting the conversion of heat back into electricity;

(l) condensing the spent steam by means of cold water being passed from said cold water storage location means to said hot water storage location means; and (m) storing the hot water produced in step (1) in said hot water storage location means for use during lower power demand system charging periods as the hot water of step (a) above.

2. The process of claim 1 wherein the hot low vapor pressure organic heat retention material stored in step (h) is at a temperature of from 450° to 600° F and the cold LVP material stored in step (i) in the cold storage location means is at a temperature of about 150°-300° F.

3. The process of claim 1 wherein the low vapor pressure organic heat retention material is a hydrocarbon distillate boiling between 500°-1300° F.

4. The process of claim 3 wherein the hydrocarbon distillate is selected from the group consisting of a 650°-1050° F vacuum gas oil cut, a 600°-950° F catalytically cracked cycle stock, a 600°-1000° F thermally cracked gas oil cut, a 600°-1000° F doubly extracted and dewaxed vacuum pipe still cut, a 600°-900° F VT hydrocracked cut and a 600°-900° F VT coker gas oil wherein all of the above materials have been hydrotreated.

5. The process of claim 3 wherein the low vapor pressure organic heat retention material contains 1% or less anti-oxidants and dispersants.

6. The process of claim 5 wherein the antioxidants are selected from the group consisting of hindered phenols.

7. The process of claim 5 wherein the dispersants are selected from the group consisting of sulfonates.

8. A process for storing the excess electrical output of an electricity generating plant by conversion into heat and recalling said heat during periods of peak power demand by reconversion into electrical power comprising the steps of:

(a) during periods of low power demand drawing hot water from a hot water storage location means;

(b) conducting said hot water to heat exchanger means;

(c) contacting said hot water in heat exchanger relationship with a heat transfer fluid;

(d) vaporizing said heat transfer fluid and directing the resultant cool water via a cooler into a cold water storage location means; '(e) conducting the heat transfer fluid vapor of step (d) to a compression means;

(f) compressing said heat transfer fluid vapor in the compressor means by utilizing excess electrical power of a power source;

(g) contacting and condensing said compressed heat transfer fluid vapor in heat exchanger relationship with a low vapor pressure (LVP) organic thermal energy heat retention material moving from cold storage location means to hot storage location means through the heat exchanger means;

(h) storing the hot LVP material;

(i) during periods of peak power demand using hot LVP material moving from hot storage location means to cold storage location means to vaporize a heat transfer fluid in heat exchanger means;

(j) directing said hot heat transfer fluid vapor to an expansion engine;

(k) running the expansion engine on the heat transfer fluid vapor thereby converting thermal energy into mechanical energy;

(l) using the mechanical energy produced by the expansion engine to run a generator thereby yielding electrical power;

(m) condensing the expanded heat transfer fluid vapor by means of cold water flowing from cold water storage location means to hot water storage location means; and (n) storing said hot water in a hot storage location means for use in step (a) during system charging periods.

9. The process of claim 8 wherein the heat transfer fluid is selected from the group consisting of freon, water, propane, propylene, butanes, ammonia and pentanes.

* * * * *